US005454254A

United States Patent [19]

Mueller

[11] Patent Number: 5,454,254

[45] Date of Patent: Oct. 3, 1995

[54] CAN BODY MAKER APPARATUS WITH AIR ACTUATOR REDRAW MECHANISM

[75] Inventor: Peter M. Mueller, Littleton, Colo.

[73] Assignee: Aluminum Company of America, Pittsburgh, Pa.

[21] Appl. No.: 174,237

[22] Filed: Dec. 28, 1993

[51] Int. Cl.[6] ..... B21D 22/28

[52] U.S. Cl. ..... 72/349; 267/122

[58] Field of Search ..... 72/347, 349, 350; 267/122

[56] References Cited

U.S. PATENT DOCUMENTS 2,846,983 8/1958 Otto ..... 267/122

3,667,707 6/1972 Mui ..... 267/122

4,976,131 12/1990 Grims et al. ..... 72/347

*Primary Examiner*—Lowell A. Larson

*Attorney, Agent, or Firm*—Thomas R. Trempus

[57] ABSTRACT

An air bag actuator is incorporated into the redraw motion assembly of a can body maker apparatus to maintain a cam actuated arm in compression during the reform cycle. Additionally, a housing is provided to enclose an air bag actuator, preventing axial displacement of the air bag and inadvertent damage to it during operations. The air bag actuator also functions as a pivotal link in the redraw system and eliminates the need for a complex pneumatic systems that include surge tanks, air supply tanks, and housing.

6 Claims, 2 Drawing Sheets

CAN BODY MAKER APPARATUS WITH AIR ACTUATOR REDRAW MECHANISM

FIELD OF THE INVENTION

This invention relates generally to can body makers and more particularly to the redraw system of a can body maker. An air spring actuator is incorporated into the redraw motion assembly to maintain a cam actuated arm in compression during the redraw cycle. Additionally, a housing is provided to enclose the air spring actuator, preventing axial displacement of the air spring and inadvertent damage to it during operations.

BACKGROUND OF THE INVENTION

A conventional can body maker apparatus is disclosed in U.S. Pat. No. 3,696,659, issued to J. H. Maytag and an improvement to the ram assembly of the can body maker ram assembly is disclosed in U.S. Pat. No. 4,934,169, issued to C. M. Grimes, et al. Both of these patents are assigned to Adolph Coors Company and are incorporated herein by reference as if fully set forth. An example of a conventional redraw system is also disclosed in U.S. Pat. No. 3,735,629, issued to Elpidofor Paramonoff, and assigned to Standun Inc. The assignee of the instant invention is also the assignee of co-pending application, "improved Body Maker Apparatus," Ser. No. 899,201, which discloses a counterbalance mass system that improves the speed and efficiency of can body makers.

Can body makers produce elongated can bodies from shallow metal cups or can shells. The can shells have a wall thickness of approximately 0.009 to 0.012 inch, and the elongated can bodies have a wall thickness reduced to approximately 0.0045 inch. In a conventional can body maker apparatus, a ram is movably mounted for reciprocal, straight line motion at rates sufficient to form from between 180 and 220 can bodies per minute. The stroke length, that is the distance traveled by the movable ram, is between about 18 to 26 inches. As a general rule, for a given can body maker, the shorter the ram stroke, the greater the rate or number of cycles per minute at which the ram can be operated. Misalignment as small as between about 0.0005 and 0.0010 inch can result in the formation of defective cans. In conjunction with the reciprocal motion of the ram, a redraw sleeve is supported in a redraw assembly and engages the can shell prior to the contact of the can shell by the ram. The redraw sleeve engages the shell prior to contact be the ram, applying a restraining force against the shell as the shell is worked through a redraw die. The redraw process elongates the sidewalls of the can shell and decreases the sidewall thickness and overall diameter of the can shell. The redraw operation is followed by two or three ironing stations that further elongate and thin the walls of the can shell to form a one piece can body. Finally, the bodymaker can be equipped with a doming station that further forms the enclosed bottom of the can body into a desired structural configuration.

The redraw assembly operates at the same rate as the ram assembly. Mechanical linkage is provided between the main crank shaft of the can body maker and both the ram assembly and the redraw assembly. The specific linkage that translates the motion of a cam mechanism into the linear straight line motion required by the redraw assembly includes a cam follower, idler arm, push rod, and pneumatic assembly, all of which are required to effect the reciprocal motion of a redraw sleeve carriage assembly. The pneumatic biasing system includes a pneumatic cylinder, or piston that supplies the force necessary to maintain the cam follower in contact with the cam surface. The pneumatic system is very complex and includes an air cylinder, surge tank, and connecting hoses, all of which require significant attention during operation and continuous maintenance. Needless to say, such existing pneumatic assemblies are complex and can present potential for accidents typically associated with high pressure pneumatic systems. Additionally, common nuisances such as leaky fittings, cracked air hoses, etc., often will accompany a pneumatic system as complex as the one that is currently used with a can body maker redraw assembly.

SUMMARY OF THE INVENTION

An improved actuator system for use with the redraw assembly in a can body maker apparatus includes an air spring actuator that both functions as a flexible linkage and replaces the complex, maintenance intensive, conventional pneumatic biasing system. The actuator is a self contained biasing means in mechanical communication with a redraw assembly actuator push rod. It generally maintains the actuator rod in a compressive state.

The air spring actuator of this invention has a first end and a second end. A separate air spring housing substantially encloses the air spring actuator and has an enclosed end with an inner face and an outer face, side walls extending from the enclosed end inner face and defining an opposite, open end. The housing receives the air spring actuator in a substantially enclosed relationship. A mounting means is adapted to secure the actuator's first end to the frame of a can body maker apparatus. Another mounting means is adapted to secure the actuator's second end to the inner face of the housing such that the housing substantially encloses the air spring actuator. A third mounting means is adapted to operatively attach the housing outer face with an actuating bar. This third mounting means is a pivot point that allows the air spring actuator to function as a flexible linkage in the redraw push rod. The air spring actuator applies force to the actuating bar in order to maintain the actuating bar in a generally compressive state in order to maintain contact between the cam follower and the cam surface.

The invention also provides an improvement to the structure of air spring actuators. According to a preferred embodiment of the invention, an air spring actuator is substantially enclosed within a supporting housing. The supporting housing has an enclosed end with an inner face and an outer face, and a continuous side wall extending from the enclosed end inner face and defining at its terminus, a second, open end. A mounting means is adapted to secure the air spring actuator upper mounting plate to the housing inner face such that the housing substantially encloses the air spring actuator bellows throughout the compression and expansion cycles of said air spring actuator. This embodiment provides a fixed mounting surface at one end of the air spring actuator and a pivotable mounting surface at the other end.

It is an object of this invention to provide an improved can body maker that incorporates a unique actuator system that eliminates the conventional air spring/air cylinder system employed in the redraw system.

It is also an object of this invention to provide an improved actuator system that economically replaces the complex air spring/air cylinder system employed in the redraw system.

It is yet another object of this invention to improve pneumatic air actuator devices through the use of an external supporting structure that substantially eliminates side loading and the resulting misalignment that can cause bending, scoring, and undesired deterioration to the flexible surface of the actuator.

It is another object of this invention to relieve critical alignment tolerances of conventional redraw pneumatic biasing systems.

It is also an object of this invention to eliminate the constant requirement for a supply of discharge air makeup employed in conventional redraw pneumatic discharge biasing systems.

BRIEF DESCRIPTION OF THE DRAWINGS

The above as well as other features and advantages of the invention can be more fully appreciated through consideration of the detailed description of the invention in conjunction with the several drawings in which.

DETAILED DESCRIPTION OF A PREFERRED EMBODIMENT

Figure 1:
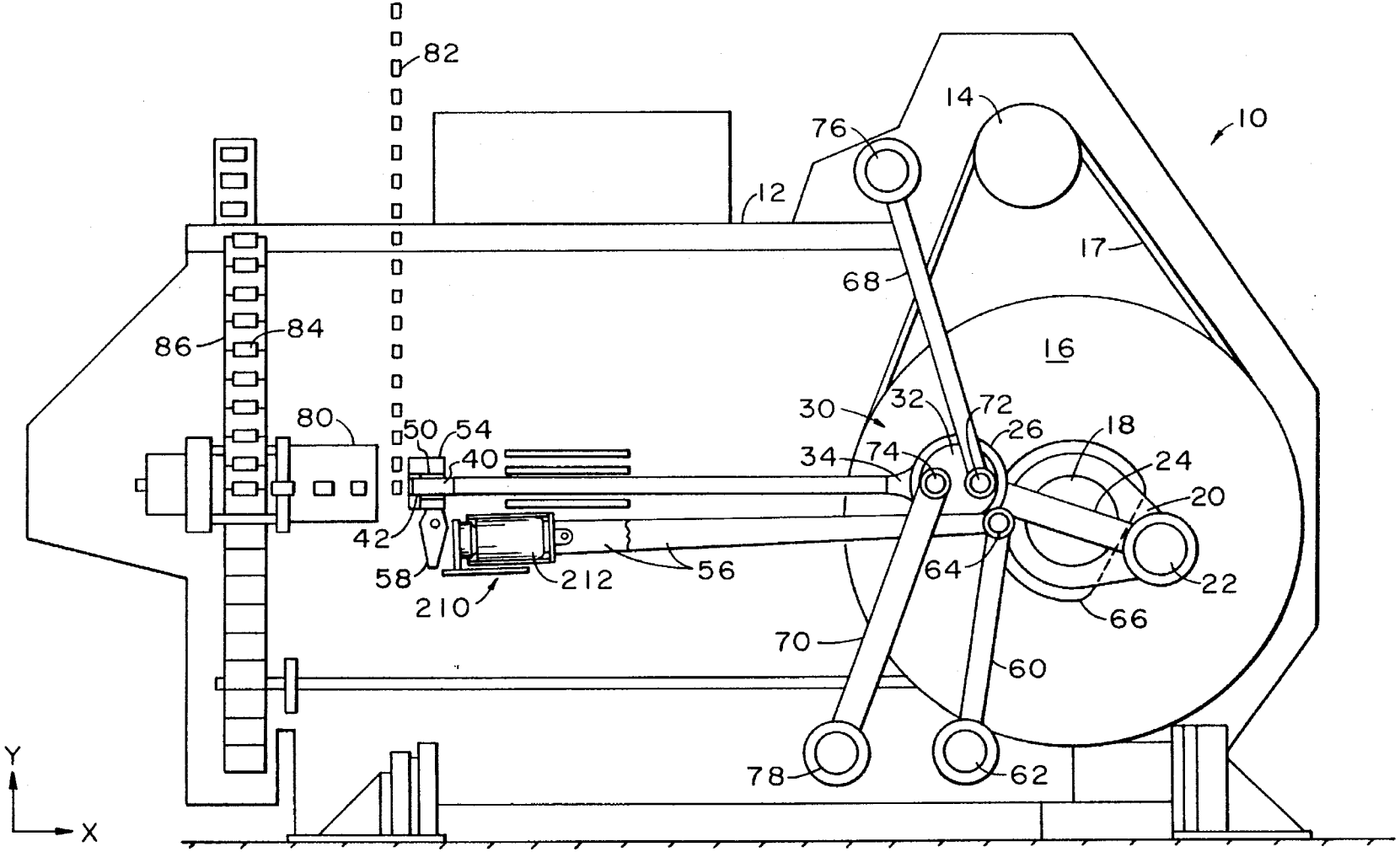
FIG. 1 is an somewhat diagrammatic view of a can body maker apparatus incorporating the improved actuator system in the redraw assembly.

A typical can body maker apparatus is shown in FIG. 1 and is generally indicated by the reference character 10. The can body maker 10 includes a frame or housing structure 12 having mounted thereon a motor 14 that drives a large pulley wheel 16 by a belt 17. The pulley wheel 16 is fixedly mounted on one of a pair of transversely extending axially aligned crankshafts 18 with crank arms 20. The crankshafts 18 are rotatable in bearings mounted in opposite sides of the frame 12. The crank arms 20 are connected together by a crank pin 22 extending through the bearings of a main connecting rod 24 which terminates at its other end in two parallel transversely spaced apart arms for engaging the circumferential surfaces of a cross head member 26, which is part of the straight line motion assembly generally designated by the reference character 30. The pivotal point of the assembly is designated 32. The cross head member 26 is engaged circumferentially by the end of a carriage connecting rod 34. The carriage connecting rod 34 is connected at its other end to a ram assembly 40, in which is mounted a ram 42.

A redraw sleeve assembly 50 is mounted at its rearward end to a redraw carriage 54. The redraw carriage 54 is pivotally connected to a downwardly directed rocker arm 58. The rocker arm can be connected at either one side, or preferably at both its right and left sides, to an elongated redraw sleeve actuating bar 56 that generally is parallel to the ram 42 and movable in longitudinal, or X axis, direction independently of the ram. Each actuating bar 56 is adapted at its rearward end to support a cam follower lever 60 which has its lower end mounted on a fixed pivot 62 on the frame 12. The upper end of the cam follower lever 60 includes a cam follower 64 for contacting a cam surface 66 on the crank assembly for transmitting the rotary action of the crank into the reciprocal motion of the redraw sleeve assembly.

The ram or straight line motion assembly 40 includes a side thrust resisting, upper swing lever 68 and lower swing lever 70, both bifurcated at their inner ends so as to straddle the cross head member 26. The upper swing lever 68 is pivotally connected to the cross head member 26, as indicated at 72, and the lower swing lever 70 is pivotally connected at 74 to the cross head member 26. The upper end of the upper swing lever 68 is pivotally connected to the fixed pivots 76 on frame members 12, and the lower end of the lower swing lever 70 is pivotally connected to the fixed pivots 78 on frame members 12.

A tool pack housing 80, mounted in the left hand portion of the can body maker as illustrated in FIG. 1, encloses a series of drawing and ironing dies (not shown) through which a workpiece such as a cup 82 is worked by the ram in combination with the redraw assembly 50. The cup 82 is drawn and ironed into a can body 84 and a suitable transport system 86 conveys the can body 84 from the body maker 10.

The redraw operation is the most important function in the can making process. The redraw sleeve assembly 50 is located in front of the ram assembly 40 next to the die housing assembly 80. The redraw carriage 54 provides the alignment structure for the redraw sleeve and the redraw sleeve aligns the metal cup 82 with the die face of the redraw die 80. In order to maintain an accurate thin-wall dimension, it is desirable that the draw pressure be applied evenly around the cup and the redraw sleeve aligned precisely relative to the ram and the cup according to pre-established specifications. If a minimum pressure on the cup is not evenly maintained or if the redraw sleeve is not precisely aligned, quality problems in the drawing and ironing process result. Such problems include extensive wear or damage to the redraw motion assemblies, the redraw sleeve itself, and can bodies which have extensive damage. Can body damage can include flange wrinkling under the face of the redraw sleeve, can shell crushing, and can shell misfeed, and ultimate shutdown of the equipment.

The redraw sleeve assembly 50 and actuating bar 56 move forwardly and rearwardly as the cam followers 64 travel along the rotating cam surface 66. In conventional can body makers, a complex, pneumatic system, i.e., air cylinder, surge tank, and lines, applies sufficient force to maintain the actuating bar cam follower in contact with the cam surface. This force is in a rearward direction in a generally x axis of the can body maker. The air spring assembly of the instant invention, generally indicated at the reference character 210, eliminates the conventional complex pneumatic system while providing superior performance. The air spring assembly 210 applies sufficient pressure against the actuating bar to maintain contact between the cam followers 64 and the cam face.

Applicant has developed a unique biasing system for use in a redraw assembly. The improved biasing system eliminates the need for complex air cylinders, surged tanks and associated pneumatic plumbing. Moreover, the instant invention can be retrofitted into an existing can body maker apparatus of the type generally shown in FIG. 1. The improved biasing assembly of the present invention is generally indicated at the reference character 210 and includes an internal air spring actuator 212 having a first end 214 and a second end 216. The actuator 212 is a commercially available product designed and sold by Firestone Industrial Products Company under the trademark Firestone Airstroke Actuator. A specific model identified by Firestone Industrial Products Company as 1T14F-4 has been found particularly suitable for use as a component part of this invention. The actuator 212 is an air spring consisting of a side wall 213 and bellows portion 215 proximate the second end 216 formed from a rubber/fabric. The side wall and bellows, in combination with a piston 217, define an enclosed chamber which contains a column of compressed air. The actuator itself does not provide force or support a load. Rather, support is provided by the column of air contained by a side wall and the bellows. The standard fabric of the air actuator side wall and bellows is made of four layers comprising an inner layer of calendered rubber, one ply of fabric reinforced rubber, a second ply of fabric reinforced rubber, and an outer cover of calendered rubber. In most manufacturing environments, it is typical to have a house supply of air available at a pressure of approximately 80 psi. This house supply of air is sufficient to charge the air actuator when used in combination with a conventional air amplifier that boosts the house supply to approximately 100 to 140 psi. It has been found that the air spring actuator biasing system of the present invention is capable of functioning at high speeds when charged to the aforedescribed pressure. Moreover, during routine maintenance of the body maker, safety considerations dictate that any biasing system be de-pressurized. In prior art pneumatic systems, de pressurizing and then re pressurizing of the pneumatic biasing system is a time consuming process that typically requires the use of a high pressure commercial air supply. On the other hand, the air spring actuator 212 of the instant invention greatly simplifies and reduces the time necessary to first bleed the pressure from the air spring actuator and then complete the re pressurizing process.

An air spring housing 220 has an enclosed end 222 with an inner face 224 and an outer face 226. Sidewalls 228 extend from the enclosed end 222 inner face 224 and define a second, open end 230. The housing 220 is adapted to receive therein the air spring actuator 212 in a substantially enclosed relationship. The opened second end 230 is of a first diameter which is slightly larger than the diameter of the first end 214 of the actuator 212. Thus, the housing 220 is able to enclose the end 214 of the actuator. The air spring housing substantially minimizes the potential for the single column structure to buckle under load. Additionally, the side wall 228 of the housing 220 is adapted to receive therein in an enclosed relationship, the actuator 212. In a fully inflated condition, approximately 80% of the outside diameter surface of the air actuator side wall will be in contact with the inside diameter surface of the air spring housing. The specific relationship of the inside diameter of the air spring housing to the outside diameter surface of the air spring actuator can be adjusted to modify the characteristics of the air spring actuator. The actuator 212 includes a bellows portion 215 proximate the piston 217 adapted to permit the axial displacement of the second end 216 of the actuator 212 relative to the first end 214 of the actuator. While the inner edge 232 of the open end 230 of the housing 220 is not in physical contact with the second end 216 of the actuator, the housing 220 substantially limits side loading displacement or misalignment as the bellows 215 effects the axial expansion and contraction of the actuator 212.

The outer face 226 of the housing 220 includes a clevis 234 which is in mechanical communication with the push rod or actuating bar 56 of the can bodymaker. The clevis can include a ball pivot bearing. The clevis connection with the push rod provides a flexible link by functioning as a pivot point in the system. As described above, the actuator bar 56 is forced in a rearward direction, relative to the tool pack in the front of the body maker. The rearward force ensures the constant contact of the cam follower 64 against the cam face.

Figure 2:
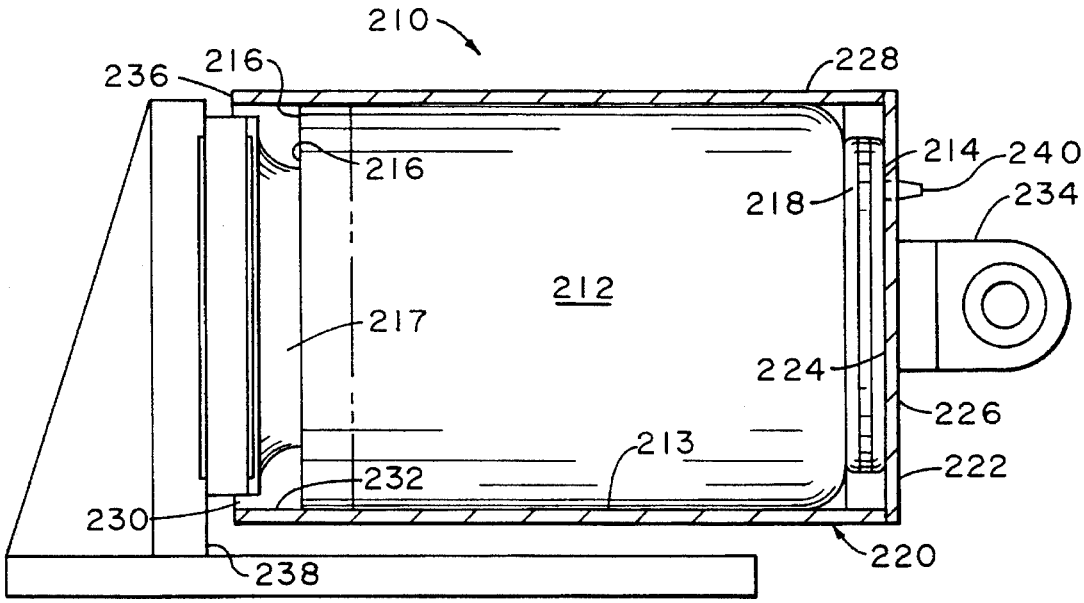
FIG. 2 is an elevational view of the air spring actuator and sectional view of the housing all according to this invention.
Figure 3:
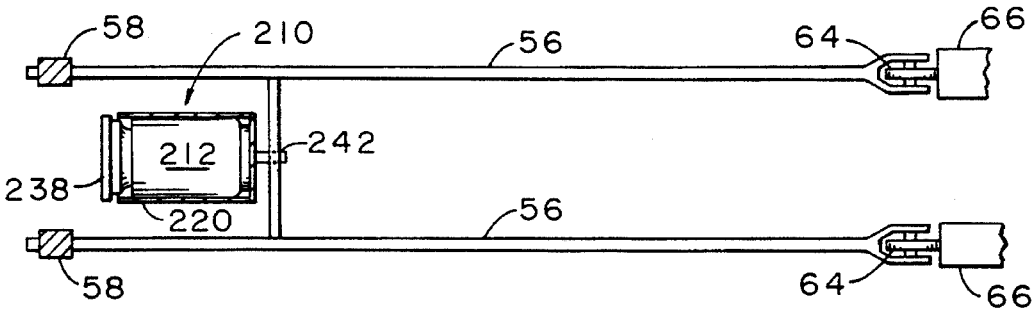
FIG. 3 is a somewhat diagrammatic, plan view of the air spring actuator and housing of this invention and selected linkage of the redraw assembly.

In operation, as the cam follower and redraw idler arm urge the actuator bar forward, the actuator 212 is compressed. As can be seen in FIG. 2, clearance is provided between the terminating edges 236 of the side wall 228 at the open end 230 of the housing 220 and the actuator first end mounting plate 238. The physical compression of the actuator 212 in turn compresses the column of air contained within the actuator which tends to heat and to expand the column of air. The expansion of the compressed heated gas in turn provides the reactive force necessary to force the actuating bar rearwardly during the low rotation of the cam. The expansion of the compressed gas provides the necessary axial displacement to maintain the actuating bar and its cam follower against the cam face. The compressed gases contained within the actuator 212 provide a predetermined force which can be adjusted according to the no-load pressure of the air within the actuator. A single air fitting 240 is provided to charge the air spring actuator 212 to a desired pressure as well as to provide a relief for bleeding the air spring actuator as described above for maintenance or to modify the characteristics of the system.

The instant invention is adapted to be incorporated into existing can body maker apparatus in order to eliminate the current air cylinder structure and the attendant maintenance requirement associated with it. Additionally, it has been discovered that the use of the housing 220 in combination with an actuator 212 substantially eliminates difficulties encountered due to misalignment problems experienced when a non axial load is applied to the actuator. The housing 220 eliminates potential rod bending, scoring and excessive seal wear in the cylinder itself. The specific relationship of the air spring housing to the surface of the air spring actuator can modify the characteristics of the air spring actuator. For example, for a constant pressure within the air spring actuator, a change in the diameter of the housing will effect the dynamic characteristics of the air spring actuator system, The present invention has been described in an illustrative manner. It is to be understood that the terminology which has been used is intended to be in the nature of words of descriptive rather than limitation. Many modifications and variations of the preset invention are possible in light of the above teachings. Therefore within the scope of the appended claims, the present invention may be practiced otherwise than as specifically described.

What is claimed is:

1. In an apparatus for the manufacture of can bodies having:

(a) a frame;

(b) drive mechanism including a cam surface and a crank, both adapted for rotation about a first axis in said frame;

(c) ram means mounted in said frame for reciprocal, straight line motion;

(d) rod means operatively connecting said crank with said ram means for imparting reciprocal motion to said ram means;

(e) redraw means operating in cooperation with said ram means for forming can blanks into elongated can bodies mounted in said frame for reciprocal straight line motion;

(f) actuating bar means operatively connecting said cam surface with said redraw means for imparting reciprocal straight line motion to said redraw means; and (g) biasing means for maintaining said actuating bar means in contact with said cam means; the improvement wherein said biasing means comprises:

(i) an air spring actuator having a first end and a second end;

(ii) an air spring housing having an enclosed end with an inner face and an outer face, side walls extending from said enclosed end inner face and defining a second, open end, said housing adapted to receive therein said air spring actuator in a substantially enclosed relationship and support axial alignment of said biasing means;

(iii) mounting means adapted to secure said actuator first end to said frame;

(iv) mounting means adapted to secure said actuator second end to said housing inner face such that said housing substantially encloses said air spring actuator; and (v) mounting means adapted to operatively attach said housing outer face and said actuating bar means to provide reactive force against said actuating bar throughout the motion of the redraw means, wherein said biasing means functions as a flexible link between said frame and said actuating bar means.

2. The apparatus according to claim 1 wherein the air spring actuator includes a side wall of a predetermined outside diameter and the air spring housing side wall of a predetermined inside diameter and wherein at least a portion of said side wall is in contact with said side walls of said air spring housing.

3. The apparatus according to claim 2 wherein the relationship of the air actuator side wall relative to the air spring housing inside wall is selected to modify the air spring actuator characteristics.

4. The apparatus according to claim 1 wherein the approximately 80% of the air actuator side wall outside diameter is in contact with the air spring housing side wall.

5. The apparatus according to claim 1 wherein mounting means adapted to operatively attach the housing outer face and the actuating bar means to provide reactive force against the actuating bar throughout the motion of the redraw means functions as a pivot point and the air spring apparatus is a flexible connection in the apparatus.

6. Self contained biasing means for use in an apparatus for the manufacture of can bodies comprising: (i) an air spring actuator having a first end and a second end; (ii) an air spring housing having an enclosed end with an inner face and an outer face, side walls extending from said enclosed end inner face and defining a second, open end, said housing adapted to receive therein said air spring actuator in a substantially enclosed relationship; (iii) mounting means adapted to secure said actuator first end to said apparatus' frame; (iv) mounting means adapted to secure said actuator second end to said housing inner face such that said housing substantially encloses said air spring actuator; and (v) mounting means adapted to operatively attach said housing outer face and an actuating bar means; wherein said air spring actuator maintains said actuating bar in a compressive state during operation of the apparatus, and said air spring actuator functions as a flexible linkage between said apparatus' frame and said actuating bar means.

* * * * *